US007735554B2

(12) United States Patent
Tillman

(10) Patent No.: US 7,735,554 B2
(45) Date of Patent: Jun. 15, 2010

(54) SYSTEM AND METHOD FOR RECOVERY OF FUEL PRODUCTS FROM SUBTERRANEAN CARBONACEOUS DEPOSITS VIA AN ELECTRIC DEVICE

(75) Inventor: Thomas C. Tillman, Sugar Land, TX (US)

(73) Assignee: Texyn Hydrocarbon, LLC, Houston, TX (US)

( * ) Notice: Subject to any disclaimer, the term of this patent is extended or adjusted under 35 U.S.C. 154(b) by 0 days.

(21) Appl. No.: 12/056,960

(22) Filed: Mar. 27, 2008

(65) Prior Publication Data

US 2008/0236817 A1 Oct. 2, 2008

Related U.S. Application Data

(60) Provisional application No. 60/908,947, filed on Mar. 29, 2007.

(51) Int. Cl.
*E21B 43/24* (2006.01)

(52) U.S. Cl. ..... 166/272.3; 166/272.7; 166/60; 166/302

(58) Field of Classification Search ..... 166/272.1, 166/272.3, 272.6, 272.7, 302, 59, 60
See application file for complete search history.

(56) References Cited

U.S. PATENT DOCUMENTS

| | | | | |
|---|---|---|---|---|
| 3,865,186 | A | 2/1975 | Von Hippel | |
| 4,067,390 | A | 1/1978 | Camacho | |
| 4,356,866 | A | 11/1982 | Savins | |
| 4,422,505 | A | 12/1983 | Collins | |
| 4,648,450 | A | 3/1987 | Gash | |
| 4,662,443 | A | 5/1987 | Puri | |
| 4,747,642 | A | 5/1988 | Gash | |
| 4,776,638 | A | 10/1988 | Hahn | |
| 5,082,054 | A * | 1/1992 | Kiamanesh | 166/248 |
| 6,380,268 | B1 | 4/2002 | Yakobson | |
| 2004/0251241 | A1 | 12/2004 | Blutke | |
| 2007/0114026 | A1 * | 5/2007 | La Rovere et al. | 166/272.7 |
| 2008/0217321 | A1 * | 9/2008 | Vinegar et al. | 219/492 |
| 2008/0271885 | A1 * | 11/2008 | Kaminsky | 166/245 |
| 2008/0314593 | A1 * | 12/2008 | Vinegar et al. | 166/302 |

OTHER PUBLICATIONS

International Search Report and Written Opinion for PCT/US2008/058599 dated Aug. 20, 2008 (9 pages).

* cited by examiner

*Primary Examiner*—Shane Bomar
(74) *Attorney, Agent, or Firm*—Conley Rose, P.C.

(57) ABSTRACT

A system for gasification of carbonaceous deposits below the ground surface comprising: an injection well assembly comprising one end positioned at the ground surface and the opposite end of the injection well assembly located within the carbonaceous deposit; a production well assembly comprising one end positioned at the ground surface and the opposite end of the production well assembly located within the carbonaceous deposit; a non-vertical reaction shaft assembly located within the carbonaceous deposit a distance below ground surface, the non-vertical reaction shaft having a length and comprising an injection end in communication with the end of the injection well assembly located within the carbonaceous deposit and a production end in communication with the end of the production well assembly located within the carbonaceous deposit; and a mobile electric device configured to move within the non-vertical reaction shaft assembly. A method for gasifying underground carbonaceous deposits using an electric device.

40 Claims, 8 Drawing Sheets

SYSTEM AND METHOD FOR RECOVERY OF FUEL PRODUCTS FROM SUBTERRANEAN CARBONACEOUS DEPOSITS VIA AN ELECTRIC DEVICE

CROSS-REFERENCE TO RELATED APPLICATIONS

The application claims the benefit of U.S. Provisional Application Ser. No. 60/908,947 filed Mar. 29, 2007, herein incorporated by reference in its entirety for all purposes.

STATEMENT REGARDING FEDERALLY SPONSORED RESEARCH OR DEVELOPMENT

Not Applicable.

BACKGROUND OF THE INVENTION

1. Field of the Invention

The invention relates to underground gasification of carbonaceous deposits. More specifically, the invention relates generally to an apparatus and method for the recovery of fuel products from subterranean deposits of carbonaceous matter using a mobile, electric device in a horizontal well-bore.

2. Background of the Invention

It is estimated that approximately 50% of existing coal is located too deep within the earth to be mined conventionally. Due to regulatory, safety, and environmental demands, some mining operators are being forced to close their mines, leading to a decrease in the productivity of traditional coal production in particular, and for coal use as an energy source in general. This has led to research on the feasibility of underground coal gasification, UCG.

Underground gasification has several inherent advantages over conventional mining, including the avoidance of safety and health hazards related to the underground mining of coal, avoidance of the environmental impact which occurs during strip mining of coal, avoidance of problems of spoil banks, slag piles and acid mine drainage. Additionally, UCG has demonstrated an ability to recover coal from seams unsuitable for conventional mining techniques.

In U.S. Pat. No. 4,776,638, Hahn describes a method for electro-thermal and electrochemical underground conversion of coal into oil and by-products. The method comprises inserting an underground probe into a bore hole until the probe is in close proximity with a coal seam. A mixture of air, steam, an electrolyte, and a suitable catalyst is supplied to the probe via a feed supply line, and the mixture is sprayed directly on the coal seam through a passage in a nozzle. Tunnels of limited horizontal reach, about 100 to 150 feet in length, are formed by advancing the probe away from the vertical well bore in a substantially horizontal direction into and through the coal seam during conversion. Products are removed from the same vertical well bore.

In U.S. Pat. No. 4,067,390, Camacho et al. describe an apparatus and method utilizing a plasma arc torch as heat source for recovering useful fuel products from in situ deposits of coal, tar sands, oil shale, and the like. When applied to a coal deposit, the plasma torch is lowered in a vertical shaft into the deposit and serves as a means for supplying heat to the coal and thereby stripping off the volatiles. The fixed carbon is gasified by reaction with steam that is sprayed into the devolatilized area and product gases are removed from the same vertical shaft. Umbilicals are provided for carrying electrical power, plasma gas, and cooling water. The plasma arc torch operates in a transferred mode wherein the arc is attached to an external forwardly-placed, axially aligned torch-mounted electrode.

In U.S. Pat. No. 4,648,450, Gash et al describe an underground coal gasification process containing a system of injection and production wells. The injection well is positioned at an angle with respect to horizontal of less than the angle of repose of loose coal and char for the particular coal seam, and the production well is positioned at an angle with respect to horizontal of greater than the angle of repose, but less than 90°. Each cavity in the operation can be individually valved to injection and production pipelines where a number of cavities are used in one coal seam. An oxygen-containing gas mixture is injected into the seam through the injection well and combustion products removed from the production well. An excess of oxygen-containing gas such as air or oxygen, or a mixture thereof, steam and oxygen, or carbon dioxide and oxygen is introduced to form a highly volatile and combustible combination within the coal deposit. This is ignited by electrical means or by the introduction of pyrophoric mixtures. In U.S. Pat. No. 4,662,443, Gash et al describe use of an air-blown underground coal gasification plant to produce low-BTU gas and an oxygen-blown plant for the production of product gas from which synthetic natural gas may be produced.

U.S. Pat. No. 4,422,505 to Collins describes a method for gasifying subterranean coal deposits by positioning a cased injection well to extend from the surface into the coal deposit with the injection well extending horizontally through the lower portion of the coal deposit with the horizontal portion of the well being cased with a perforated casing; positioning an injection tubing within the injection well; positioning a production well to extend from the surface to a point near the lower end of the injection well; igniting the coal deposit; gasifying a portion of the coal deposit between the bottom of the production well and the lower end of the injection tubing well by injecting a free-oxygen containing gas into the coal deposit through the injection tubing and recovering product gases through the production well and thereafter gasifying a second portion of the coal deposit by withdrawing the injection tubing a selected distance and thereafter injecting free-oxygen containing gas into the coal deposit and recovering product gases from the production well. By the process of this invention, the use of vertical gas injection wells is eliminated. The invention purports to utilize no coolant. Desirably, a high temperature alloy (e.g., stainless steel) injection nozzle is positioned on the lower end of the injection tubing.

Little progress has been made in processes for in situ gasification of coal in the past two decades primarily due to a lack of economic incentives. There remains the risk of potential environmental contamination of near-surface potable aquifers, due to working within proximity to the surface. There remain challenging technical problems such as the inability to adequately control the process. One particular technical problem is the ability to achieve high reaction temperatures at low cavity pressures, and thus the production of product gas of desired quality and quantity.

Accordingly, there remains a need for a safe and effective system and method for recovering energy from deeper carbonaceous deposits. In certain embodiments, the system and method should reduce the number of injection and/or production wells, thus minimizing surface disturbance, product leakage, and other negative environmental impact, should also allow for much deeper extraction of carbonaceous deposits, and/or should allow for higher reaction temperatures and pressures, and the control of these and other process parameters.

SUMMARY OF THE INVENTION

Certain embodiments of the invention relate to a system for the gasification of a carbonaceous deposit located below the ground surface, the system comprising: at least one injection well assembly comprising one end positioned at the ground surface and the opposite end of the injection well assembly located within the carbonaceous deposit; at least one production well assembly comprising one end positioned at the ground surface and the opposite end of the production well assembly located within the carbonaceous deposit; at least one non-vertical reaction shaft assembly located within the carbonaceous deposit a distance below ground surface, the at least one non-vertical reaction shaft having a length and comprising an injection end in communication with the end of the injection well assembly located within the carbonaceous deposit and a production end in communication with the end of the production well assembly located within the carbonaceous deposit; and a mobile electric device comprising at least one electric torch.

The carbonaceous deposit may comprise at least one selected from the group consisting of coals, kerogen, shale oils, tar sands, and combinations thereof.

In certain embodiments, the at least one injection well assembly is within 15 degrees of vertical. In certain embodiments, the horizontal reaction shaft assembly diverges from horizontal by less than about 30 degrees.

The mobile electric device may comprise a non-transferred arc plasma torch. In some embodiments, the at least one electric device comprises at least two discharge heads. The mobile electric device may be a mobile directional electric device.

In some embodiments, the horizontal reaction shaft is lined by a thermally-consumable casing material. In some embodiments, the distance below ground surface is greater than about 1,000 feet (304.8 m). In certain embodiments, the distance below ground surface is in the range of from about 3,000 feet (914.4 m) to about 8,000 feet (2438.4 m) and beyond.

The length of the at least one non-vertical reaction shaft may be greater than 1,000 feet (304.8 m). In some embodiments, the length of the at least one non-vertical reaction shaft is in the range of from about 10,000 feet (3048.0 m) to 15,000 feet (4572 m) and beyond.

In certain embodiments, the only fluid inlet into the system is one or more inlets for water.

The production well assembly may further comprise at least one product casing, at least one steam jacket casing surrounding at least a portion of the at least one product casing, and at least one external water jacket casing surrounding at least a portion of the at least one steam jacket casing, wherein the external water jacket casing comprises an inlet for water and wherein the steam jacket casing comprises an outlet for steam and wherein the product casing transfers product gasification gas from the non-vertical reaction shaft assembly to the surface. At least one of the at least one steam jacket casing and the at least one product casing may be capable of expanding independently and/or at different rates of thermal expansion as compared to the at least one external water jacket casing. In certain embodiments, at least one casing selected from the at least one product casing and the at least one steam jacket casing comprises spacers, whereby the at least one casing remains substantially concentric with the at least one external water jacket casing during gasification of the carbonaceous deposit.

Certain embodiments of the invention also relate to a method for gasifying a carbonaceous deposit located below the ground surface, the method comprising: positioning a mobile electric device comprising at least one discharge head within a non-vertical reaction shaft assembly having a length, an injection end and a production end and wherein the non-vertical reaction shaft assembly is positioned at least partially within the carbonaceous deposit a distance of preferably at least 1,000 feet (304.8 m) below ground; and creating a discharge gas at a temperature with the mobile electric device whereby a portion of the carbonaceous deposit is gasified producing a reaction cavity. The carbonaceous deposit may comprise at least one selected from the group consisting of coals, kerogen, shale oils, tar sands, and combinations thereof.

In certain embodiments, the electric device is attached to one end of each of at least one retaining cables whereby each of the at least one retaining cables extends from the electric device through an injection well to the ground surface; and wherein the production end of the non-vertical reaction shaft assembly is in communication with a below-ground end of a production well, and wherein the injection well comprises one end in communication with the ground surface and one end in communication with the injection end of the non-vertical reaction shaft assembly. The at least one retaining cable may surround or comprise one or more selected from insulated electrical conductors, grounds, and combinations thereof.

In certain embodiments, the production well further comprises at least one product casing adapted to transfer product gasification gas from the non-vertical reaction shaft assembly to the surface, at least one steam jacket casing surrounding at least a portion of the at least one product casing, and at least one external water jacket casing surrounding at least a portion of the at least one steam jacket casing; and wherein the method further comprises injecting water into at least one inlet of the external water jacket casing and extracting steam from at least one outlet of the steam jacket casing. At least one of the at least one steam jacket casing and the at least one product casing may be capable of expanding independently and/or at a different rate of thermal expansion as compared to the at least one external water jacket casing. At least one casing selected from the at least one product casing and the at least one steam jacket casing may comprise spacers, whereby the at least one casing remains substantially concentric with the at least one external water jacket casing during gasification of the carbonaceous deposit.

In certain embodiments of the method for gasifying a carbonaceous deposit, the non-vertical reaction shaft assembly diverges from vertical by more than 15 degrees. The mobile electric device may comprise a non-transferred arc plasma torch. The electric device may comprise at least two discharge heads. The mobile electric device may be a mobile directional electric device.

In certain embodiments, the distance below ground surface is greater than about 3,000 feet (914.4 m). In some embodiments, the distance below ground surface is in the range of from about 3,000 feet (914.4 m) to about 8,000 feet (2438.4 m) or beyond. In some embodiments, the length of the horizontal reaction shaft is greater than 1,000 feet (304.8 m). In some embodiments, the length of the non-vertical reaction shaft is in the range of from about 10,000 feet (3048 m) to 15,000 feet (4572.0 m) or beyond.

The method for gasifying a carbonaceous deposit may further comprise injecting water as coolant, reactant, and/or moderator during gasification, whereby the mobile electric device produces steam and oxygen for its operation. In some embodiments, water is the only fluid injected into the electric device and the non-vertical reaction shaft assembly.

The temperature of the centerline of the discharge gas may be greater than about 2,000° F. (1,093° C.). In some embodiments, the discharge gas is an electric arc and the temperature of the centerline of the electric arc is greater than about 8,000° F. (4426° C.).

The method may further comprise repositioning the electric device along the non-vertical reaction shaft whereby another portion of the carbonaceous deposit may be gasified. Repositioning the electric device may comprise positioning the electric device closer to the injection end of the non-vertical reaction shaft assembly.

The method for gasifying a carbonaceous deposit may further comprise collecting product gases that exit the production well at the ground surface. The product gas may be monitored to determine at least one selected from the group consisting of gas temperature, BTU value, gas content, water content, opacity (ash content), and mass flow rate of the product gas. At least one operating parameter may be adjusted in response to the monitoring. The at least one operating parameter may be selected from injection rate of fluid provided to the electric device, electric device power, positioning of the electric device within the non-vertical reaction shaft and combinations thereof.

The disclosed method for gasifying a carbonaceous deposit may be utilized to continuously gasify portions of the carbonaceous deposit along substantially the entire length of the non-vertical reaction shaft assembly. In some embodiments, the method further comprises operating the mobile electric device only during off-peak electrical demand periods, storing up heat in the reaction cavity until another non-peak electrical demand period.

Also disclosed is a method for gasifying a carbonaceous deposit located below the ground surface, the method comprising: positioning a plasma device comprising a discharge head within a horizontal reaction shaft assembly located at least 1,000 feet (304.8 m) below ground, the horizontal reaction shaft assembly having a length, an injection end, and a production end, and wherein the horizontal reaction shaft assembly is positioned at least partially within the carbonaceous deposit; and creating a plasma gas at a temperature with the plasma torch whereby at least a portion of the carbonaceous deposit is gasified producing a reaction cavity, wherein the only fluid introduced into the horizontal reaction shaft assembly during substantially all of the gasification is water.

Embodiment of the invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of embodiments of the invention, reference will now be made to the accompanying drawings, wherein.

NOTATION AND NOMENCLATURE

Figure 1:
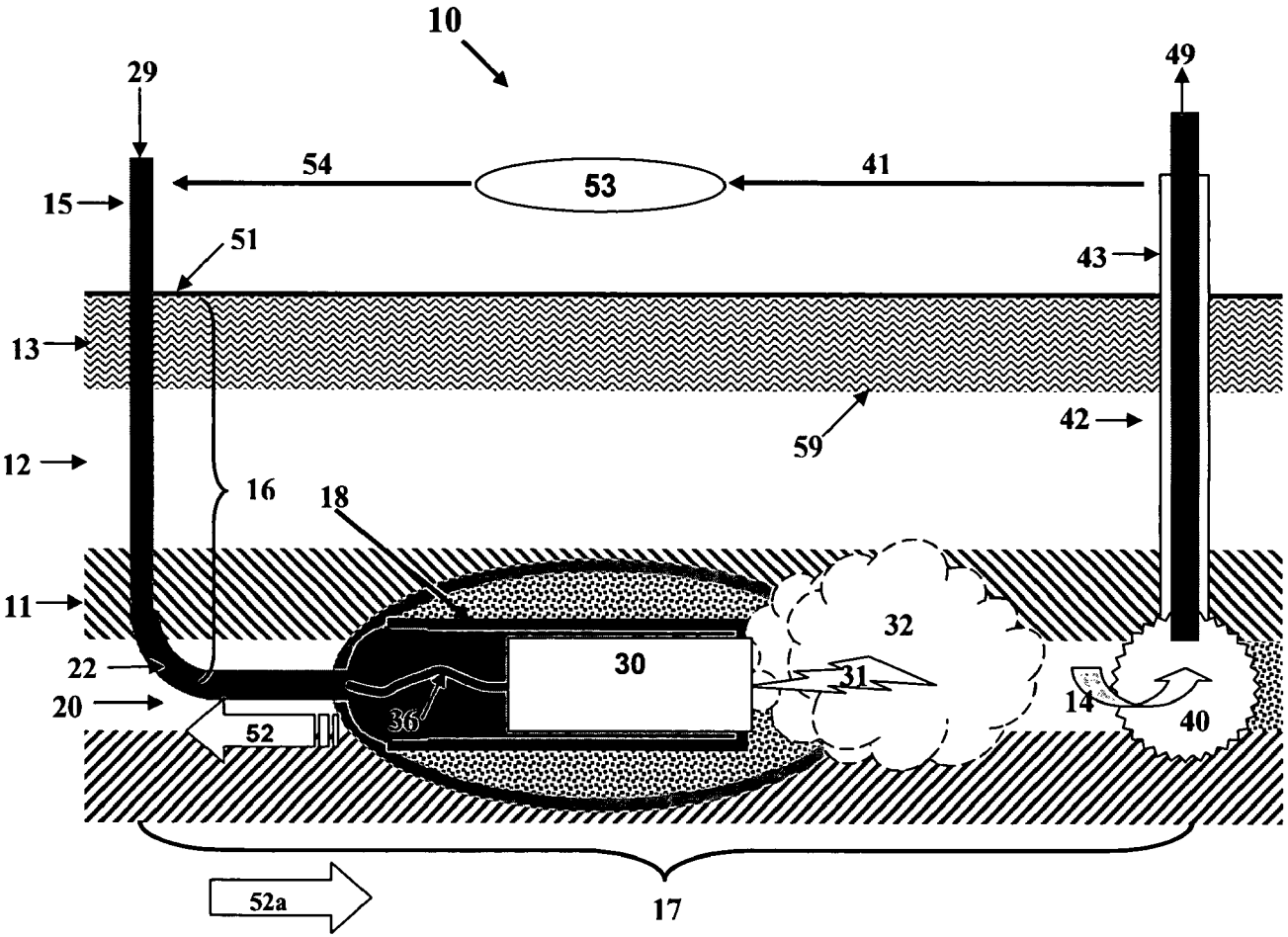
FIG. 1 is a schematic of an embodiment of a gasification system in accordance with the invention.

The terms "non-vertical reaction shaft" and "horizontal reaction shaft" are used to refer to shafts which deviate by at least 15 degrees from vertical. "Horizontal" reaction shaft assembly 20 may be referred to herein as a "horizontal" shaft although it may deviate by up to about 85 degrees from horizontal.

The term "mobile" as used herein with respect to "mobile electric device" is used to indicate that the electric device (e.g., plasma torch) is positionable within non-vertical reaction shaft assembly (horizontal reaction shaft assembly) 20 and may be repositioned therein.

The term "directional" as used herein with respect to "mobile directional electric device" is used to indicate that, in embodiments, the discharge 31 of the mobile electric device 30 may be directed about the axis of the electric device 30.

The term "reaction zone" is used herein to refer to the area in which gasification reactions are occurring. The term "reaction cavity" is used to refer to the cavity 14 produced by the gasification reactions.

DETAILED DESCRIPTION

The system and method of this disclosure provide a means for the recovery of energy products from underground coal seams and other carbonaceous matter. Embodiments of the systems and methods for the gasification of coal or another carbonaceous deposit in situ comprise an electric device, which may be used to add heat to a reaction zone, create from the cooling water the required steam which serves as moderator, and/or further provide oxygen via the dissociation of steam which serves as oxidant for the reactions.

Methods discussed herein are particularly advantageous where the carbon resource is deep. In situ gasification is generally favored by depth and high pressure. The pressure at a depth of 4,000 feet (1,219 m) may be, for example, greater than about 2000 psia (13.8 MPa). However, delivering from the surface the steam moderator and oxidant at these depths and pressures, as well as controlling the reaction rate and temperature, represent unique challenges, which have not been overcome in the prior art, but have been addressed via certain systems and methods of this disclosure.

These challenges have been addressed; inter alia by utilizing an electrically powered, underground coal gasifier that creates its own steam and oxygen at the point of reaction from injected water. The torch method disclosed herein provides an increase in reaction temperature, pressure, depth, flow rate, capacity and/or cleanliness as compared to current Underground Coal Gasification (UCG) methods. The torch method may increase reaction temperature, pressure, depth, flow rate, capacity and/or cleanliness by a factor of at least two, and perhaps more than ten, compared to current UCG methods.

The carbonaceous deposit to be gasified may comprise any suitable carbon resource. Preferred feedstock is a ubiquitous source that is not currently in high demand. A preferred ultra-low cost (near-zero value) feedstock is stranded, deep coal. Because the system and method of this disclosure may be utilized to obtain energy from deep carbonaceous deposits, new reserves, which have previously remained untapped by previous methodologies having significantly less capability, become viable sources of energy via this invention.

The disclosed method and system preferably eliminate the traditional pressure-vessel style of gasifier and essentially turn the gasifier inside-out, bringing the gasifier to the coal rather than vice versa. Traditional gasifiers are used in combination with an associated oxygen plant. The utilization of electric device and very high temperature steam via this disclosure eliminates the need for an associated oxygen plant for gasification.

The system and method provide a safer and more environmental-friendly method of extracting energy from carbonaceous deposits as compared with traditional mining methods, for example compared with coal mining Environmental, Health, and Safety (EHS) guidelines. Embodiments of the system and method create controlled lightning in a deep coal seam, converting water into ultra-high temperature steam (plus hydrogen and oxygen) for the gasification of the coal, and subsequent returning product gases to the surface.

Figure 2:
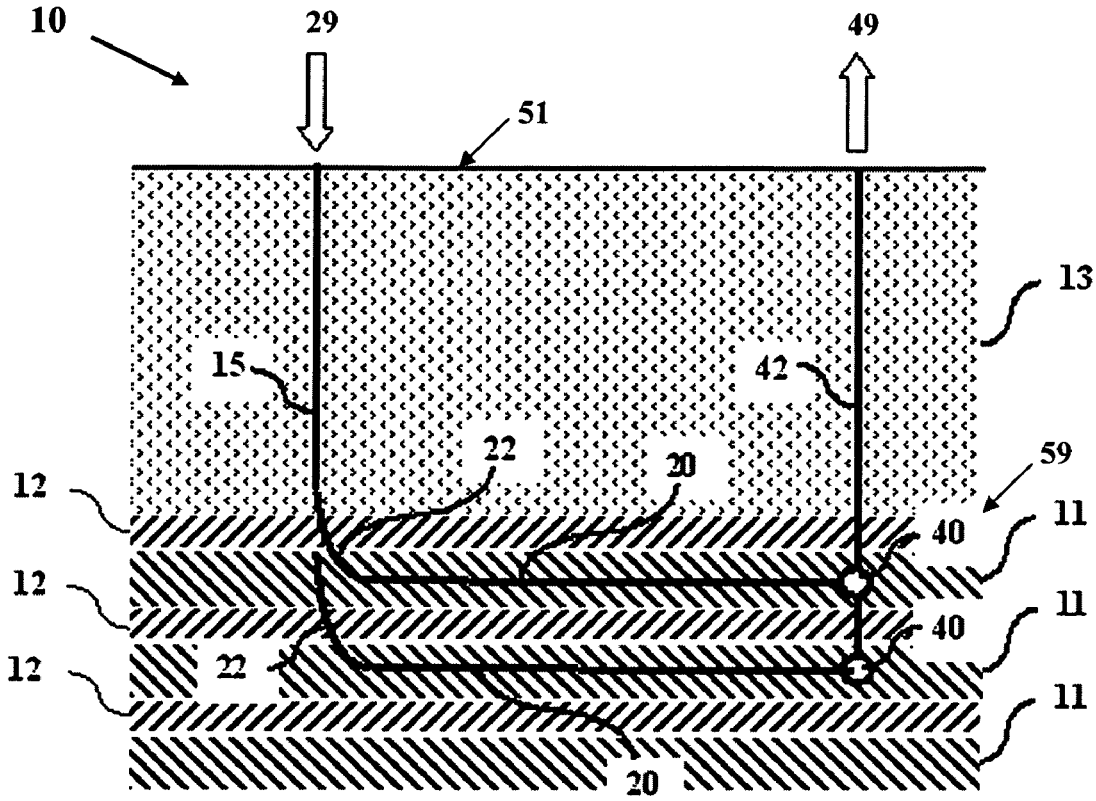
FIG. 2 is a schematic of another embodiment of a gasification system in accordance with the invention.

FIG. 1 is a schematic of a gasification system 10 according to an embodiment of the invention. FIG. 2 is a schematic of another embodiment of a gasification system 10 according to an embodiment of the invention. Gasification system 10 comprises an injection well assembly 15, a non-vertical or horizontal reaction shaft assembly 20, a production well assembly 42, and at least one electric device 30.

Referring to the drawings and particularly to FIGS. 1 and 2, a vertical section of a typical carbonaceous deposit is shown wherein carbonaceous deposits or coal seams 11 are separated by relatively narrow non-carbonaceous deposit layers or non-coal layers 12 of shale, sandstone, limestone, or the like. The carbonaceous deposit or coal seams 11 may comprise coal, including, but not limited to, lignite, sub bituminous coal, bituminous coal, anthracite, and combinations thereof. Carbonaceous deposit 11 may comprise kerogen, shale oil, bitumen, tars, tar sands and combinations thereof. By way of non-limiting example, suitable coal is sub-bituminous coal having a heating value of 9,190 BTU/lb (4,398 kJ/kg), on an as-received basis, a moisture content of about 24.1% by weight, an ash content of about 5.7% by weight, and a sulfur content of about 0.4% by weight. The coal seam 11 to be gasified may already be impregnated with another carbonaceous fuel source, for example kerogen or methane.

Although it is to be understood that carbonaceous deposit 11 is not to be limited to coal, the following description of the system and method will be made with reference to carbonaceous deposits comprising coal. Above coal seams 11 and non-coal layers 12 is an overburden 13 comprising interspersed layers of earth, sand, shale, sandstone, limestone, saline aquifers, or the like.

Figure 3A:
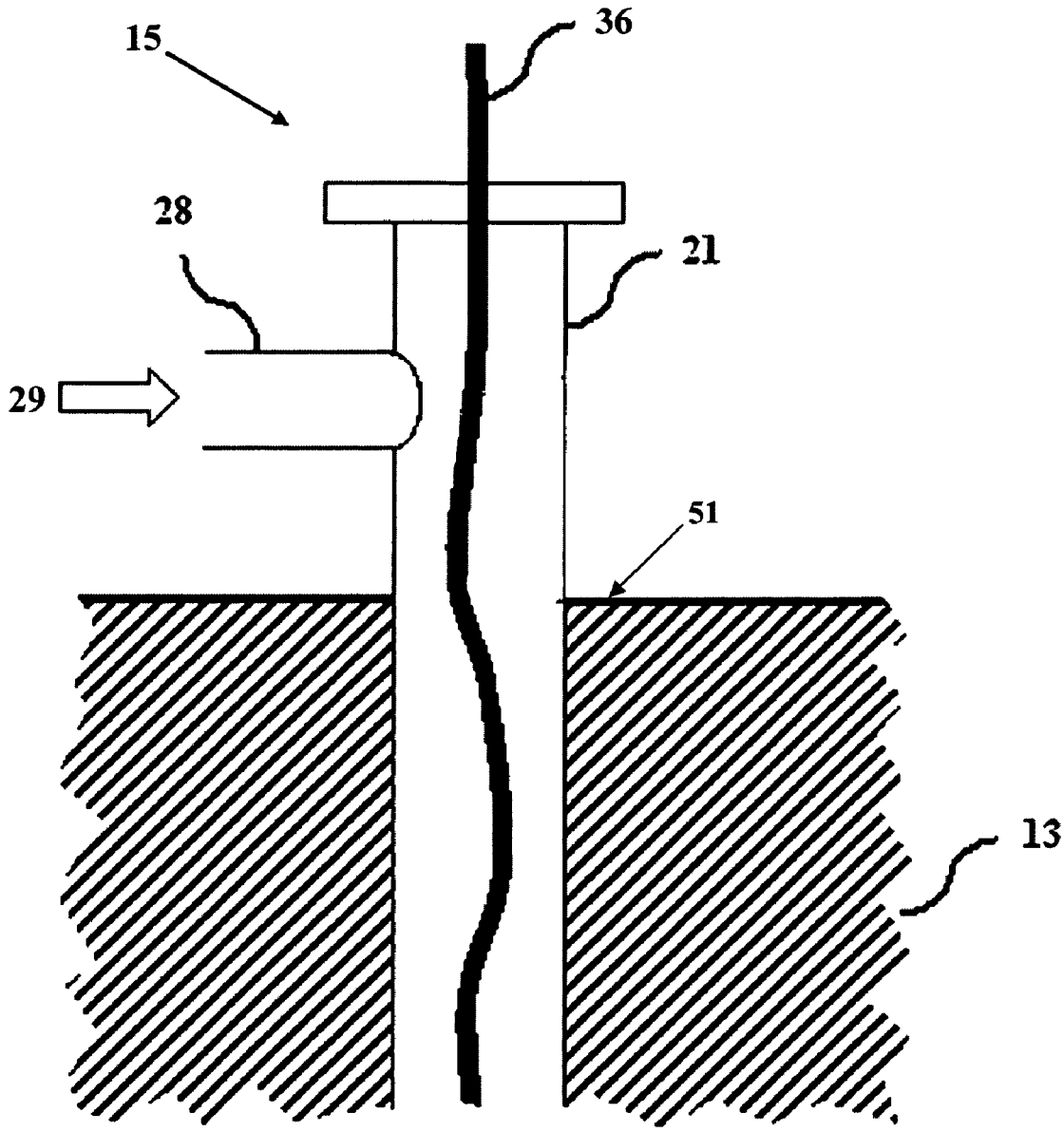
FIG. 3*a* is a schematic of an injection well assembly according to an embodiment of the invention.

System 10 comprises injection well assembly 15. Injection well assembly 15 is preferably positioned so that one topside end of injection well assembly 15 is at or above the earth surface 51, and the other below-ground end of injection well assembly 15 is positioned within the coal seam 11 to be gasified. In embodiments, injection well assembly 15 is substantially vertical. In other embodiments, injection well assembly 15 is not vertical. FIG. 3 is a schematic of an injection well assembly 15 according to an embodiment of the invention. As shown in FIG. 3, injection well assembly 15 comprises injection well casing 21. Typically, injection well casing 21 lines the entirety of injection well assembly 15.

The below-ground end of injection well assembly 15 is in communication with at least one horizontal reaction shaft assembly 20. As best illustrated in FIG. 2, in embodiments, injection well assembly 15 extends from surface 51, through overburden 13, and has a below-ground end in communication with several horizontal reaction shafts that follow the coal seam deposits 11 and that are more or less parallel to the coal seam(s) 11. Injection well assembly 15 may be a centralized injection well, with horizontal reaction shaft assemblies 20 proceeding in a radial direction therefrom.

As shown in FIG. 1, injection well assembly 15 may extend into the earth a depth 16 of greater than about 1,000 feet (304.8 m). Injection well shaft assembly 15 may extend into the earth a depth 16 of greater than about 3,000 feet (914 m). In preferred embodiments, injection well shaft assembly 15 extends into the earth a depth 16 in the range of from about 3,000 feet (914 m) to about 12,000 feet (3,656 m). In embodiments, injection well shaft assembly 15 extends into the earth a depth 16 in the range of from about 3,000 feet (914 m) to about 12,000 feet (3,657 m).

As mentioned hereinabove, gasification system 10 comprises at least one horizontal reaction shaft assembly 20. Preferably, horizontal reaction shaft assembly 20 is substantially parallel with the coal seam 11 to be gasified. As shown schematically in FIGS. 1 and 2, at least a portion of horizontal reaction shaft assembly 20 is positioned within coal seam 11 to be gasified. Preferably, substantially all of horizontal reaction shaft assembly 20 is positioned within carbonaceous deposit 11 to be gasified. Horizontal reaction shaft assembly 20 will usually be more-or-less horizontal, but may diverge from horizontal up to 85 degrees. For example, in the case of steeply dipping beds, the divergence of horizontal reaction shaft assembly 20 from horizontal may approach 75 degrees or more. Horizontal reaction shaft assembly 20 comprises an injection end positioned in proximity to the below-ground end of injection well assembly 15 and a production end in proximity with the below-ground end of production well assembly 42. The term "injection end" is used to signify that the injection end of horizontal reaction shaft assembly 20 is closer to the injection well assembly 15 than to production well assembly 42, while the term "production end" is used to signify that the production end of horizontal reaction shaft assembly 20 is closer to production well assembly 42 than to injection well assembly 15.

The distance 17 between injection well shaft assembly 15 and production well assembly 42 that is fluidly connected via horizontal reaction shaft assembly 20 may be greater than about 1,000 feet (304 m). In embodiments, distance 17 may be 3,000 feet (914.4 m). In embodiments, distance 17 may be greater than about 5,000 feet (1,524 m). In embodiments, distance 17 may be greater than about 10,000 feet (3,048 m). Alternatively, distance 17 may be greater than about 15,000 feet (4,572 m) or more. In certain embodiments, distance 17 is in the range of from about 10,000 feet to about 15,000 feet (3,048 m to 4,572 m).

Figure 7:
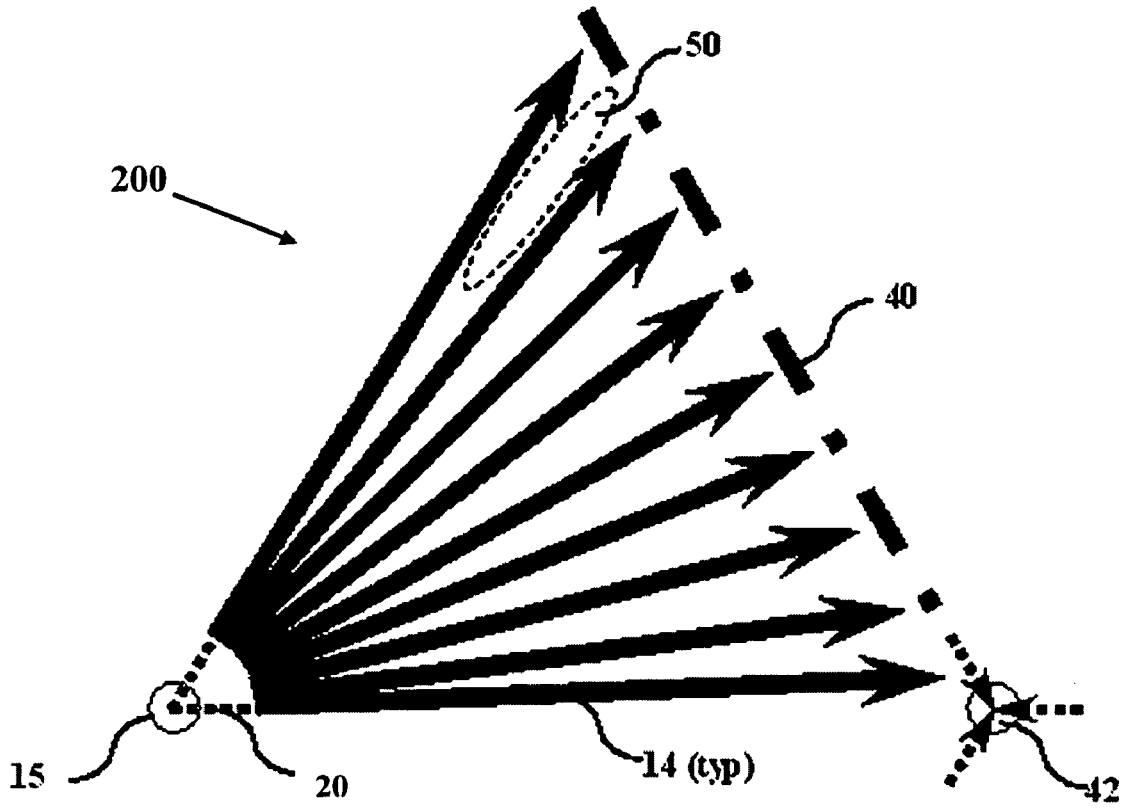
FIG. 7 is a plan view one of several possible arrays for the positioning of the injection well assembly, horizontal reaction shaft, product gallery, and production well assembly, in a typical carbonaceous deposit to be gasified.

Referring now to FIG. 1, radius injection bore 22 may provide mechanical communication between injection well assembly 15 and the injection end of horizontal reaction shaft assembly 20, as known to those of skill in the art. Horizontal reaction shaft assembly 20 is preferably lined with consumable casing 18, which may line all or a portion of assembly 20. Consumable casing 18 is constructed of a material such that the heat created by the electric device 30 and the gasification reactions erodes the portion of consumable casing 18 within reaction zone 32, thus producing reaction cavity 14 during gasification. The production end of horizontal reaction shaft assembly 20 is positioned within carbonaceous deposit 11 in proximity with a below-ground end of production well assembly 42. Using a single injection well assembly 15 and a single production well assembly 42 enables the creation of many reaction cavities 14, minimizing both surface and below-grade environmental impact. As seen in FIG. 7 and discussed in more detail hereinbelow, multiple reaction cavities 14 may be in communication with a common product gallery 40, whereby product gas may exit one or more production well assemblies 42.

Other lines may be situated within consumable casing 18. For example, a line for a start-up gas may be positioned within consumable casing 18. Such a start-up gas may be useful, for example, to initiate the electric device in an underwater environment.

Still referring to FIG. 1, gasification system 10 comprises production well assembly 42. Production well assembly 42 comprises a topside end and a below-ground end. Production well assembly 42 typically comprises product casing 43, which may line at least a portion of the production well assembly 42 from within coal seam 11 to the surface 51. The topside end, or "well-head," of production well assembly 42 comprises an outlet for product gas 49. The below-ground end of production well assembly 42 is positioned within carbonaceous deposit 11 and is in communication with the production end of horizontal reaction shaft assembly 20.

Figure 4:
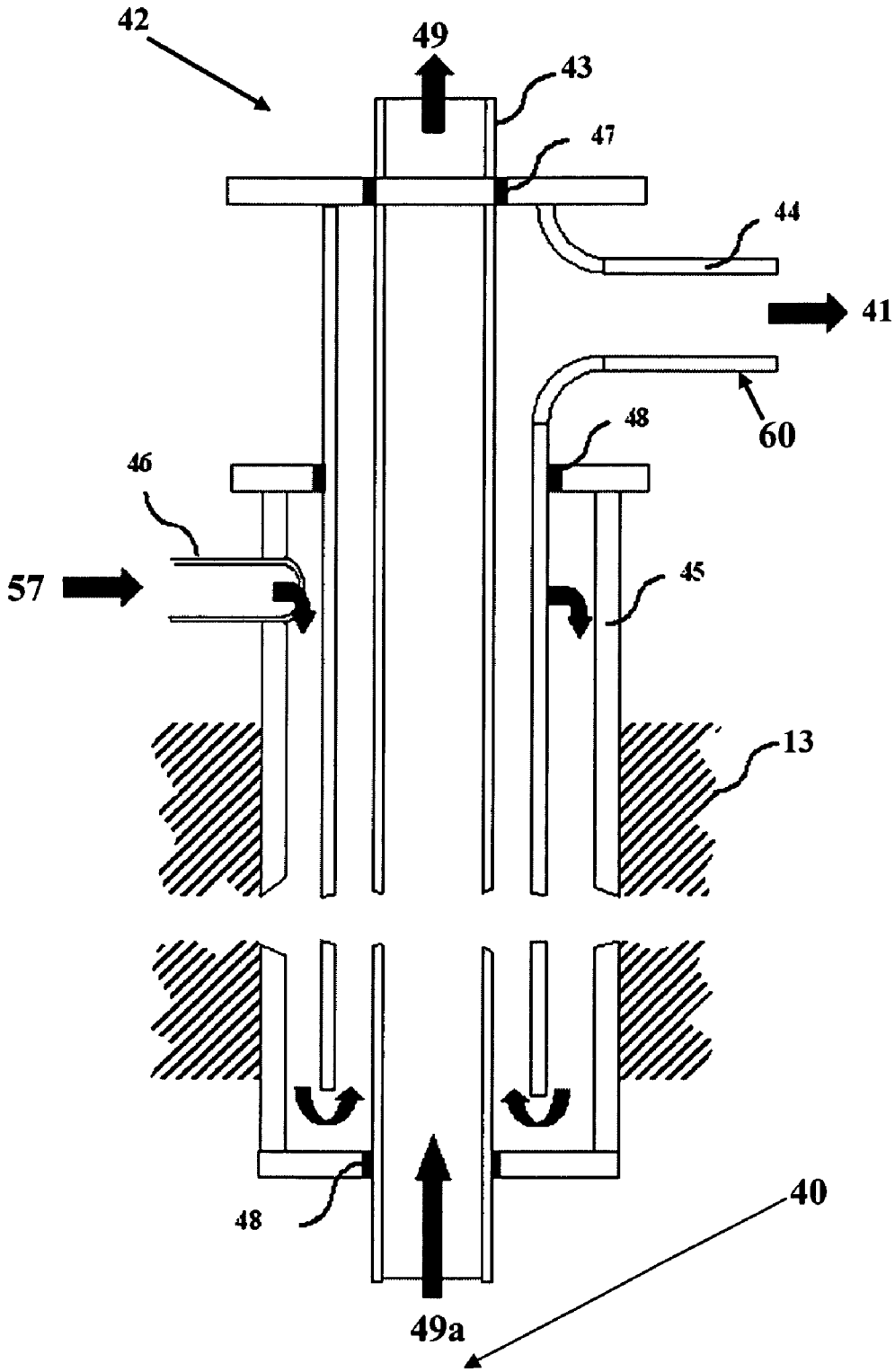
FIG. 4 is a vertical section view of a suitable production well assembly according to an embodiment of the invention

Turning to FIG. 4, a vertical section view of a suitable production well assembly 42 according to an embodiment of the invention is showing. In this embodiment, production well assembly 42 is a steam-generating production well. Because of the high temperature of the product gases 49*a* which enter product casing 43, production well assembly 42 may comprise cooling jackets such as steam jacket casing 44 and water jacket casing 45. Production well assembly 42 preferably comprises water injection line 46 through which cooling water 57 may be supplied at high pressure. Cooling water 57 will absorb heat from steam jacket casing 44 and product gases 49*a*, eventually flashing to high pressure steam. This serves to cool the reaction products 49*a* in product casing 43. Steam jacket casing 44 comprises at least one outlet 60 for high pressure steam 41. High pressure steam 41 may be used for power production or other beneficial use. For example, gasification system 10 may further comprise steam turbine 53 (see FIG. 1) which may serve to convert a portion of high pressure steam 41 into electricity. At least a portion of the electricity 54 produced may be used to provide power to electric device 30.

Due to differences in thermal expansion of the concentric casings including product casing 43, steam jacket casing 44 and water jacket casing 45, production well assembly 42 may further comprise slip joints such as topside slip joint(s) 47 and gallery slip joint(s) 48. Topside slip joint(s) 47, gallery slip joint(s) 48 or both may be positioned to allow for differential movement of casings 43, 44, 45. The clearance between product casing 43 and water jacket casing 45 of the lower slip joint(s) 48 may be exaggerated to allow for excess coolant to enter product gallery 40 at the inlet to product casing 43 so as to limit the thermal stress on product casing 43 when the temperatures of reaction product gases 49*a* might exceed the material properties of the pipe used to form product casing 43. Product casing 43 and steam jacket casing 44 may be allowed to expand independently and/or at different rates of thermal expansion as compared to the external water jacket casing 45. In such a case, the entire production well assembly 42 may be drilled into the earth in a spiral pattern, or other conventional or unconventional pattern that would allow for the lateral support of internal free-floating casings, product casing 43 and steam jacket casing 44. A spiral pattern would remove the entire production assembly 42 from a strictly vertical orientation, to an orientation that has some horizontal component. Product casing 43 and/or steam jacket casing 44 may have external lugs or spacers that provide vertical support to the inner casings, by resting on the non-vertical inner surface of an outer casing. For example, a lug or spacer attached to product casing 43 may rest on the inner surface of steam jacket casing 44. Likewise, a lug or spacer from steam jacket casing 44 may rest on water jacket casing 45. Thus, in embodiments, product casing 43 and/or steam jacket casing 44 comprise external lugs or spacers that maintain the casing (s) more or less concentric with external water jacket 45, while still allowing for differential thermal growth.

Figure 5:
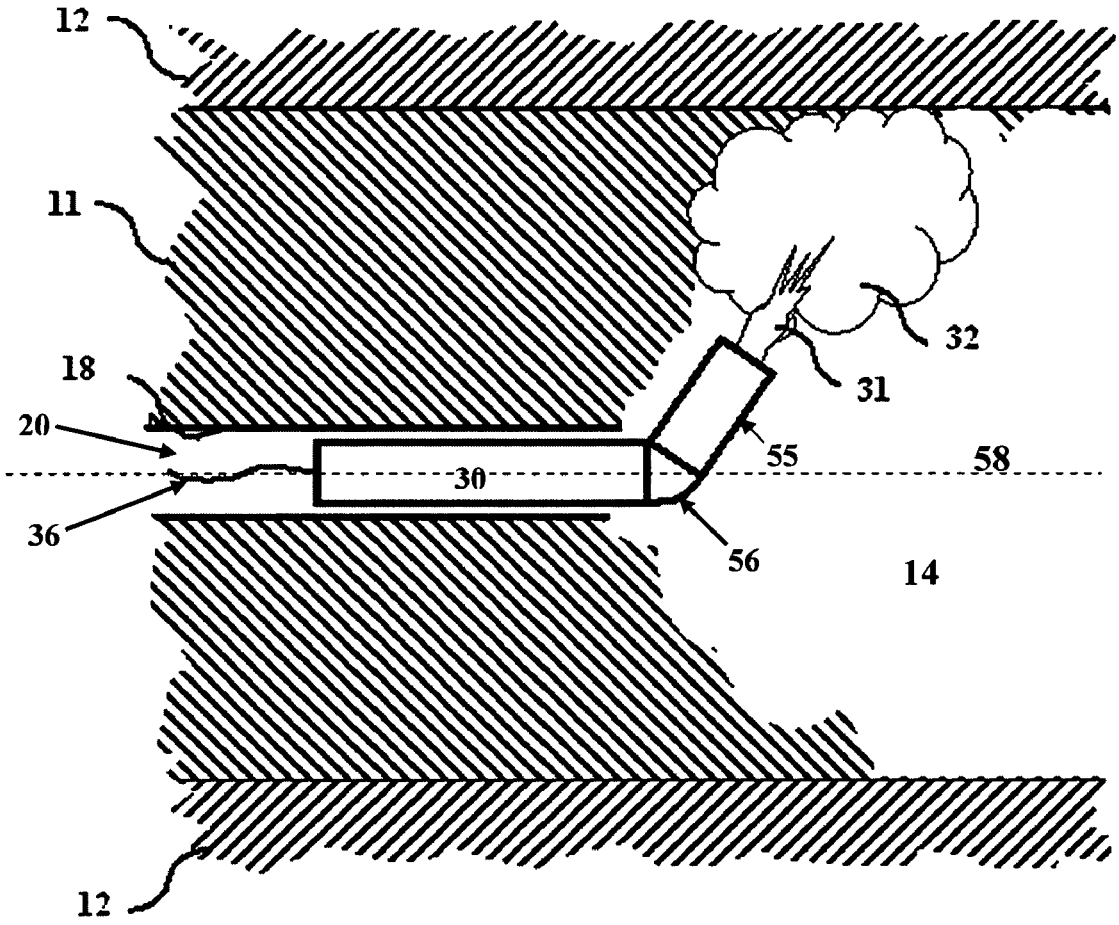
FIG. 5 is a schematic of electric device during use in gasification of a carbonaceous deposit according to an embodiment of the invention.
Figure 6:
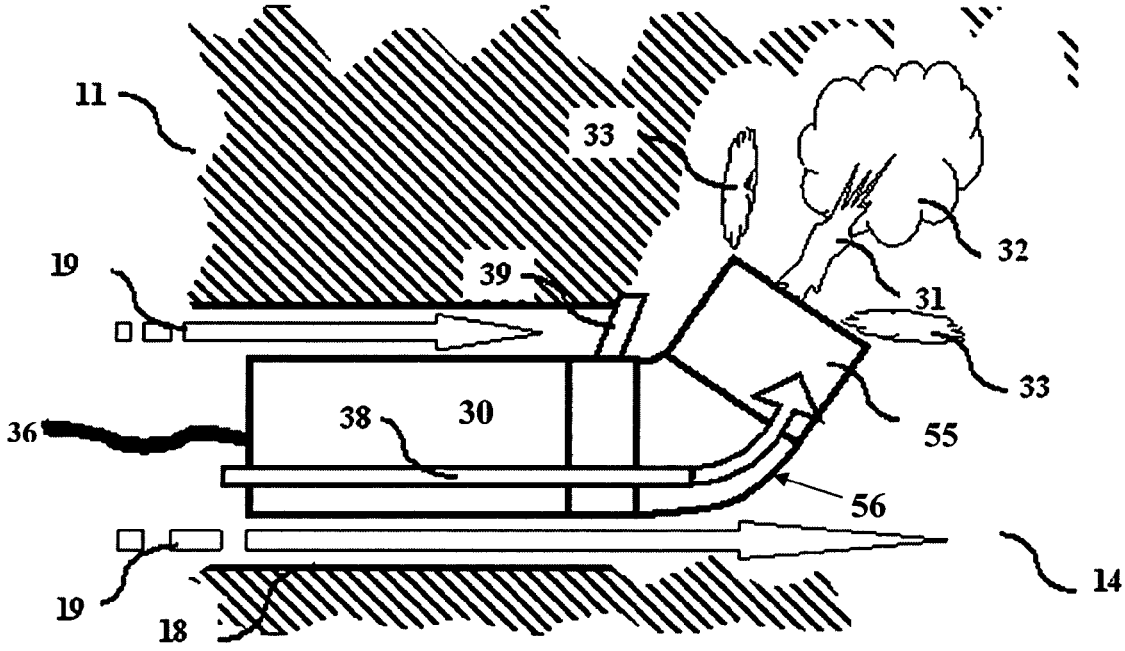
FIG. 6 is a schematic of electric device according to another embodiment of the invention.

FIG. 5 is a schematic of an electric device 30 during use in gasification of a carbonaceous deposit 11 according to embodiments of the invention. FIG. 6 is a schematic of an electric device 30 according to another embodiment of the invention. Electric device 30 promotes the thermolysis of water according to reaction (1) hereinbelow. Electric device 30 may be a transferred arc plasma torch, non-transferred arc plasma torch, self-stabilized arc plasma torch, carbon arc plasma, or high temperature heater. In embodiments, electric device 30 is selected from high temperature heaters, high temperature electrolyzers, lasers, and UV/catalytic systems. Preferably, electric device 30 comprises a high-voltage DC steam plasma torch. Electric device 30 is preferably water-cooled. Electric device 30 creates its own steam moderator and oxygen for gasification near the point of reaction. Electric device 30 may comprise more than one discharge head 55. Thus, more than one discharge head 55 may be used in a single reaction cavity 14. By way of non-limiting example, three discharge heads 55 may be used. Two discharge heads 55 may be used in thin coal seams 11 where the directions of the electric discharge patterns (e.g., plasma arcs with steam) 31 are most beneficially opposed to each other and perpendicular to axis 58 of horizontal reaction shaft assembly 20. Where seams are thin, two horizontally opposed discharge heads 55 will extend the reach into the coal seam, in the direction perpendicular to axis 58, such that the electric device 30 may gasify the maximum cross section of coal while traveling within horizontal reaction shaft assembly 20. This arrangement can provide a thin but wide cross section of coal removal. Mobile electric device 30 may be a mobile, directional electric device, thus allowing the discharge 31 to be directed about axis 58 around rotatable joint 56, as discussed further hereinbelow. In some embodiments, electric device 30 creates a high-temperature discharge at a temperature of greater than about 2,000° F. (1093.3° C.). In certain embodiments, the plasma gas is produced at a temperature in the range of from about 8,000° F. (4426.6° C.) to about 16,000° F. (8871.1° C.). In some embodiments, the plasma gas is produced at a temperature of greater than about 8,000° F. (4426.6° C.). In embodiments, the plasma gas is heated to a temperature in excess of about 16,000° F. (8871.1° C.).

Where water is used as moderator, and steam as plasma gas, gasification system 10 may further comprise one or more means for creating and storing the initial charge of steam before initiation of the plasma, which can be for example, one or more electric immersion heaters and/or storage chambers may be used to create and store the initial charge of steam before initiation of the plasma. A start-up gas may also be transported from the surface via line 25, either in sufficient quantities for real-time needs, or in a smaller flow rate that may be stored in internal chambers in electric device 30. Alternately, a storage of two separated chemical components may be stored in electric device 30 such that the mixing of these chemical components may generate sufficient start-up gas.

As best illustrated in FIG. 6, electric device 30 may comprise one or more moderator paths 38 which pass through the body of electric device 30 and terminate in one or more annular nozzles (not shown) positioned along the circumference of the head(s) 55 of electric device 30. Annular nozzles may be adapted to create moderator sprays 33 as shown in FIG. 6. Electric device 30 may be sized relative to consumable casing 18 such that, when electric device 30 is positioned within consumable casing 18, there exists a void or annular space 19 between electric device 30 and consumable casing 18 such that fluid (for example, feed water 29, seal leakage water, etc.) may pass there through.

Figure 3B:
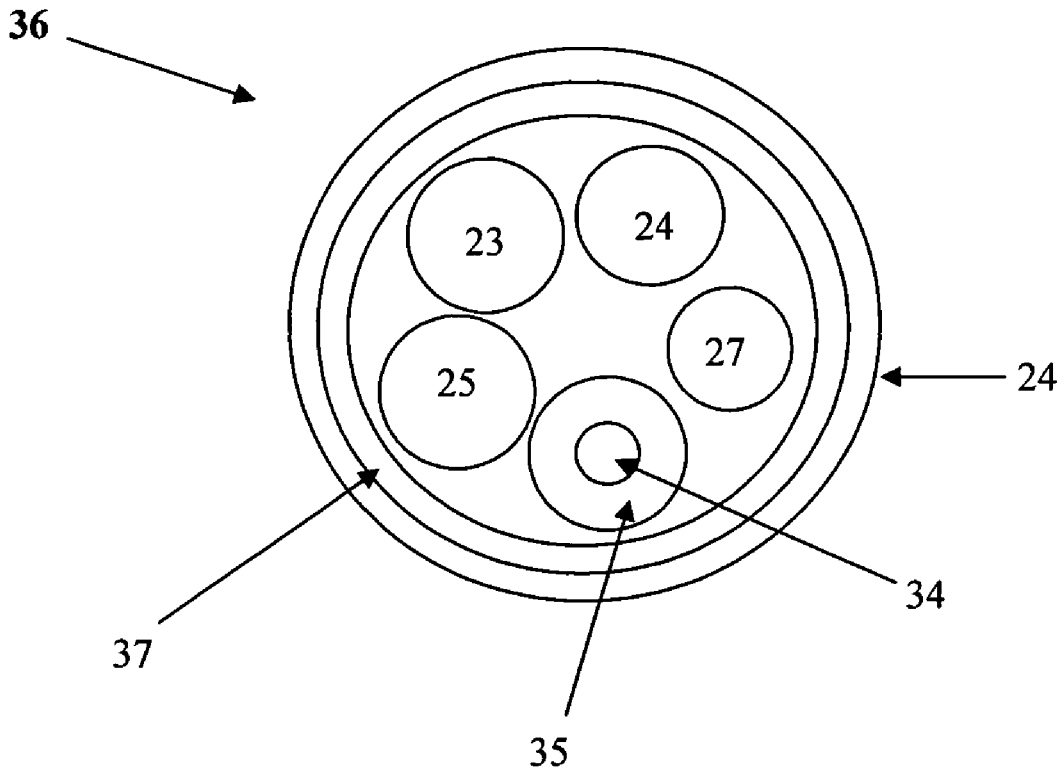
FIG. 3*b* is a schematic of an umbilical according to an embodiment of the invention.

Referring to FIG. 5, electric device 30 may carry umbilicals for supplying electrical power, plasma gas, start-up gas, moderator, oxidant, cavity coolant media, cooling water, or a combination thereof to the electric device 30. Power is supplied to electric device 30 via an umbilical 36 to electric device 30 from surface 51. As shown in FIG. 3*b*, umbilical 36 can comprise one or more conductors and/or grounds 34, which are surrounded by electrical insulation 35. Via this conductor, electrical current is carried to electric device 30. Umbilical 36 comprises a retaining cable, or sheath, 24 or other means of mechanically communicating with electric device 30 from earth surface 51. The retaining cable may envelop the conductor 34 which is insulated by electrical insulation 35. Retaining cable 24 may also act as a ground cable.

Bundled by the retaining cable 24 within umbilical 36 along with the insulated conductor may be a electric device cooling water supply line 23 to provide cooling water to electric device 30, a plasma gas supply line 25 to provide initial plasma gas during start-up of electric device 30, a moderator line 27 and/or an oxidant line 26 for supplying oxidant in addition to oxygen produced from injected water, should additional oxidant be desired. These lines may comprise flexible pipe, and may be surrounded by a further insulation layer within the retaining cable of umbilical 36.

In general, gasifiers utilize three items in addition to fuel. These are coolant to keep the hardware from melting, steam as moderator for the carbon-steam reaction, and oxygen to feed the partial-oxidation reaction. These reactions are further discussed hereinbelow Electric device 30 may be a liquid cooled device. As shown in FIG. 3, in the preferred case where water is the common coolant and moderator, and steam the plasma gas, gasification system 10 may comprise cooling water and moderator line 28 through which water may be directly injected into injection well assembly 15 and, via communication, horizontal reaction shaft assembly 20.

Still referring to FIG. 3, in some embodiments, gasification system 10 comprises a single high pressure water feed 29 that is used for coolant, reactant, and oxygen source, and gasification system 10 comprises no lines bundled with the conductor encased in electrical insulation by umbilical 36. High pressure water feed 29 may comprise water at a pressure sufficient to overcome frictional flow losses, the differential pressure of the electric device 30, and the static head of the product gases 49. Thus, multiple umbilicals are not needed for UCG, according to this disclosure. In embodiments, water may be introduced into injection well assembly 15 via cooling water and moderator line 28 at a rate sufficient to include allowances for extra steam to promote desirable reaction kinetics and for additional cooling. Electric device 30 may use a plasma torch, electric heater, or heat from the reaction cavity 14 to produce its own steam moderator from the heating of injected cooling water 28. As described further hereinbelow, some of the steam is processed through electric device 30. Much of this steam is reduced to oxygen and hydrogen molecules, atoms, and ions by the extreme temperatures created in the torch, breaking the steam down into hydrogen and oxygen, providing oxygen source, plus free hydrogen for product gas 49. The heat produced via electric device 30 significantly reduces the amount of oxygen required, such that the amount provided by the torch discharge gas itself is sufficient and no further oxidant line is required. As discussed further hereinbelow, steam and oxygen react with carbonaceous deposit 11 (e.g., coal) to produce carbon monoxide and hydrogen, according to equations (2) and (3) hereinbelow. In preferred embodiments, electric device 30 provides heat, required oxygen for the gasification reactions, and a significant fraction of the hydrogen in raw syngas product gas 49.

Turning to FIG. 6, electric device 30 may further comprise one or more boring bars, wedges, or casing splitters 39. In the event that consumable casing 18 does not completely erode during gasification, boring bar 39 or similar device is provided to remove or otherwise disable consumable casing 18 and expose further portions of carbonaceous deposit 11 to the heat of reaction cavity 14.

Gasification system 10 may further comprise monitoring equipment (not shown). In embodiments, the monitoring equipment may be positioned within production well assembly 42, within horizontal reaction shaft assembly 20, above ground surface 51, or any combination thereof. The monitoring equipment may be adapted to analyze the product gas 49 and determine the BTU content, water content, opacity, temperature and/or mass flow rate thereof.

Turning to FIGS. 1 and 2, carbonaceous deposit 11 is prepared for gasification by the drilling of an injection well assembly 15 from ground surface 51 downward to the coal seam 11 which is to be gasified. The injection well may be fully lined with casing from the ground surface 51 to the bottom 59 of overburden 13, or further into carbonaceous deposit 11.

Production well assembly 42 is also prepared by the drilling of a bore from ground surface 51 downward to coal seam 11 which is to be gasified. The production well assembly 42 may be fully lined with casing 43 from ground surface 51 to the bottom 59 of overburden 13, or further into carbonaceous deposit 11 to be gasified.

Using directional drilling techniques which are well known, drilling is steered through a radius injection bore 22 into a horizontal reaction shaft assembly 20 whose path is substantially parallel with the coal seam 11 to be gasified. In embodiments, horizontal reaction shaft assembly 20 is substantially horizontal. In other embodiments, horizontal reaction shaft assembly 20 diverges from horizontal by up to 85 degrees. For example, in the case of steeply dipping beds, the divergence of horizontal reaction shaft assembly 20 from horizontal may approach 75 degrees or more. In certain embodiments, several horizontal reaction shaft assemblies 20 spaced in an array are drilled through into carbon deposit 11 to be gasified.

FIG. 7 is a plan view of one of several possible arrays 200 for the positioning of injection well assembly 15, horizontal reaction shaft assembly 20 and production well assembly 42 in a typical carbonaceous deposit 11 to be gasified. In embodiments, multiple electric devices 30 may be used to gasify carbonaceous deposits surrounding multiple horizontal reaction shaft assemblies 20 simultaneously. In other embodiments, portions of the carbonaceous deposit surrounding multiple horizontal reaction shafts 20 are gasified in series, using one or more electric devices 30. Reaction cavities 14 are illustrated after gasification, feeding common product gallery 40. Reaction cavities 14 are voids in the coal structure left after gasification. Multiple reaction cavities 14 may be created after several gasification operations in the coal structure, and such cavities may result in a radial or parallel pattern. As illustrated, horizontal reaction shaft assemblies 20 may be spaced so that pillars 50 consisting of solid and some devolatilized coal remain between the shafts following gasification. Since gasification of the coal weakens the ability of the deposit 11 to support overburden 13, walls or pillars 50 may be left behind for support. The diameter of reaction cavities 14 remaining after gasification will vary with the composition of coal deposit 11 and with the amount of heat supplied; the distance maintained between adjacent horizontal reaction shaft assemblies 20 during drilling should be determined accordingly to provide sufficient support. The thickness of overburden 13 and the thicknesses of the interspersed non-coal layers 12 are also relevant factors in determining the amount of pillar support, if any, which should be left behind. In some circumstances, no pillar support 50 is left behind, allowing for the potential collapse of overlying strata. In embodiments, the drilling pattern 200 may be similar to the Controlled Reaction Injection Process (CRIP) pattern devised by Lawrence Livermore Labs, and known to those of skill in the art.

In certain embodiments, the drilling pattern 200 may be similar to parallel horizontal injection and production shafts used to gasify steeply dipping coal beds, as known to those of skill in the art.

Thus, in embodiments, walls or pillars 50 of non-reacted or devolatilized coal may be left behind between the completed reaction cavities 14 to prevent roof spalling, cave-in, or surface subsidence. The rate of heat addition and moderator addition may be adjusted during gasification to minimize residual stresses in overburden 13 and the nearby walls or pillars 50. Further, high heat may be used to glaze the walls of reaction cavities 14 to provide further support and prevention of water in-leakage or product leakage. The directionality of electric device 30 allows the operator to determine the size of the reaction cavity or cavities 14, as well as the cross-sectional shape or shapes thereof. The positive control of electric device 30 also allows reaction cavities 14 to traverse any faults in coal seam(s) 11.

Electric device 30 may also be used as the means of drilling the various wells and shafts, if there is a line that returns to the surface that will remove product gas from the destruction of overburden 13 or coal seam(s) 11. Otherwise, a standard drilling apparatus or rig could be used for establishing the initial wells and shafts, as known to those of skill in the art.

As best described with reference to FIGS. 5 and 6, once the injection well assembly 15, the horizontal reaction shaft 20 and production well assemblies 42 are created, electric device 30 is driven into horizontal reaction shaft assembly 20 through consumable casing 18. Electric device 30 is adapted for horizontal movement within horizontal reaction shaft assembly 20 so that it may be positioned a desired distance for heating of the carbonaceous deposit 11.

In some embodiments, when the horizontal reaction shaft or shafts 20 have been established in the coal seam(s) 11, with communication to the production well or wells 42, then electric device 30 is moved into position at the furthest production end of horizontal reaction shaft assembly 20 (i.e. the position within horizontal reaction shaft assembly 20 in closest proximity to production well assembly 42). At that time, electric device 30 is initiated and gasification begun. Concurrently, cooling media and/or moderator may be injected into the growing horizontal reaction cavity 14, for example via cooling water and moderator path 38 in FIG. 6. Where water is used as moderator, and steam as discharge gas, electric heaters or storage chambers at electric device 30 may create and store the initial charge of steam before initiation of the plasma. In other embodiments, a start-up gas line within umbilical 36 may be used to provide start-up gas for initiation of electric device 30, a moderator line bundled within umbilical 36 may be used to provide moderator during initiation, and/or an oxidant line bundled within umbilical 36 may be used to provide oxidant during initiation of the electric device 30.

In other embodiments, when the horizontal reaction shaft or shafts 20 have been established in the coal seam(s) 11, with communication to the production well or wells 42, then electric device 30 is moved into position at the injection end of horizontal reaction shaft assembly 20 (i.e. the position within horizontal reaction shaft assembly 20 in closest proximity to injection well assembly 15). At that time, electric device 30 is initiated and gasification performed substantially as described above.

In embodiments, electric device 30 uses a plasma gas to complete the electrical path between the high voltage electrodes of electric device 30. In most electric torches, such plasma gas would be an inert gas such as argon or nitrogen. However, by the disclosed method, a fluid such as steam and/or carbon dioxide may be employed as plasma gas, so as to provide reactive oxygen to reaction zone 32. Accordingly, the amount of electrical power provided to electric device 30 not only provides heat but also, in this case, supplies oxygen as a reactant. If steam is used as plasma gas, hydrogen is formed in addition to oxygen. If carbon dioxide is used as a plasma gas, carbon monoxide is formed in addition to oxygen. If a solution of hydrogen peroxide or hydrazine is used as the plasma gas, then hydrogen is formed in addition to oxygen. At sufficiently high temperatures, water will spontaneously undergo direct thermolysis, the direct thermally-driven dissociation of water into hydrogen and oxygen molecules, according to reaction (1):

$$H_2O(g) \rightarrow H_2(g) + \tfrac{1}{2} O_2(g) \quad (1)$$

At higher plasma temperatures, the molecules will break down further into ionized atoms. Additional hydrogen in product gas 49 is generally beneficial to the overall mix, depending on the desired usage of product gases 49. Direct thermolysis (thermally-driven dissociation of water) requires ultra-high temperatures, significantly greater than 2,000° F. (1093.3° C.) to begin the reaction, and greater than 8,000° F. (4426.6° C.) to drive the reaction to near-completion. These high temperatures present significant technical challenges for use within a traditional gasifier, as discussed hereinabove.

At temperatures above 8,000° F. (4426.6° C.), the Gibbs free energy, $\Delta G$, ($-RT \ln K$) [where R is the gas constant, T is the absolute temperature and K is the equilibrium constant] becomes negative and the reaction may proceed spontaneously. The steam is thus heated past the point that $\Delta G$ becomes negative, so as to drive the complete break-down of water into hydrogen and oxygen according to reaction (1). The equilibrium constant equals $(P_{H2}\, P_{O2}^{1/2})/P_{H2O}$. Excess steam, for moderator and for cooling, assists in driving the reaction equilibrium towards formation of hydrogen and oxygen.

Although some materials of construction have melting points above 5,000° F. (2760° C.), for example tungsten, tantalum carbide, graphite, etc., it is generally unfeasible to operate at temperatures of greater than 6,750° F. (3732.2° C.).

Thus, high temperature thermolysis in pressure-vessel reactors at elevated pressures is generally economically unfeasible. Using embodiments of the invention, gasification of carbonaceous deposits is performed by bringing the gasifier to the carbonaceous deposits, thus avoiding the problem of creating a pressure-vessel durable enough for thermolysis of water at high temperatures and/or high pressures.

The heat from discharge gas 31 first causes the volatiles to be stripped from the surrounding coal. This devolatilization may result in a cracking or fracturing of the coal, thereby increasing its porosity. The devolatilization and fracturing expands radially outwardly as heat front emanates from horizontal product shaft assembly 20 into the growing horizontal reaction cavity 14. The increased porosity of the devolatilized coal allows steam to flow outwardly into coal seam 11 for reacting with the fixed carbon. The discharge gas 31 and moderator spray 33 (e.g., steam) are preferably sprayed towards the walls of reaction cavity 14 at high pressure by means of one or more annular nozzles located around electric device 30, as shown in FIG. 6. The one or more annular nozzles located around electric device 30 may communicate with one or more passage lines 38 for providing moderator to reaction cavity 14. In the case where water is used as the moderator, then water may be the single liquid feed to electric device 30, performing both moderator and coolant functions. By this method, the pumping of high pressure oxygen downhole, which is a hazardous operation, is not required.

Steam serves as a moderator reactant to gasify the fixed carbon component of the coal and favors the following water shift reactions:

$$C+H_2O+\text{heat}\rightarrow H_2+CO \quad (2)$$

$$2C+2H_2O+\text{heat}\rightarrow CH_4+CO_2 \quad (3)$$

$$CO+H_2O\rightarrow H_2+CO_2+\text{heat}. \quad (4)$$

High temperature tends to favor reaction (2) and the production of $H_2$ and CO, while lower temperatures (nominally less than 1,000° F. (553.9° C.)) tend to favor reaction (3) and the production of $CH_4$ and $CO_2$. High quality synthesis gas comprises less $CH_4$ and $CO_2$, and thus the production of high quality synthesis gas is favored by the utilization of electric device 30 and high temperatures. At bulk reaction temperatures greater than approximately 2,700° F. (~1500° C.), gasification will run clean, with a raw synthesis product gas 49 comprising primarily hydrogen and carbon monoxide, and with only a minimal percentage of less desirable carbon dioxide or methane. At these bulk reaction temperatures, survival of "aromatic" or "BTX" (benzene, toluene, xylene) pollutants (also known as tars and phenol) is not possible, unlike in lower temperature UCG processes. Production of these unreacted heavier hydrocarbons will lead to the substantially complete destruction thereof in the high-temperature reaction zone 32.

In embodiments, excess steam is utilized for cooling purposes and also for the carbon-steam reaction (2). Excess steam may also promote reaction (4). Excess steam serves to discourage recombination of hydrogen and oxygen into water (lowers the partial pressures of hydrogen and oxygen relative to partial pressure of steam). This is desirable so that oxygen is available for reaction with carbon atoms from the coal. Seal leakage water may leak into an annular sealing space 19 between electric device 30 and consumable casing 18. This water acts as a coolant to both consumable casing 18 and the outside of electric device 30. Water that escapes into reaction cavity 14 will become steam and will act as a moderator to the process and/or as coolant of reaction cavity 14.

Because low reaction temperature favors the production of $CH_4$ and $CO_2$, while higher temperatures favor the production of CO and $H_2$, the temperatures in reaction zone 32 and horizontal reaction cavity 14 can be estimated in part by the composition of product gas 49. Further, the temperatures of reaction zone 32 and horizontal reaction cavity 14 may be modulated to attain the desired mixture of gases within product gas stream 49. Temperature may be modulated by many methods, including, but not limited to, variance of the power to electric device 30, change in the flow of fluid 29, and the speed of withdrawal or advancement of electric device 30 within horizontal reaction shaft assembly 20. Such modulation may be time-dependent. For example, in some embodiments, lower temperature may be provided at the virgin coal seam 11 to favor pyrolysis, perhaps with $CH_4$ and $CO_2$ production, and subsequently the temperature of reaction zone 32 is raised to favor reaction of the devolatilized carbon into synthesis gas components, CO and $H_2$.

The product gases 49*a* produced by devolatilization and gasification reactions move toward common product gallery 40 and production well assembly 42 for removal. In embodiments, as carbonaceous deposit 11 is gasified, electric device 30 is positioned closer to injection well assembly 15 by moving electric device 30, in embodiments by withdrawing umbilical 36, along the direction of travel indicated by arrow 52 in FIG. 1. In embodiments, electric device 30 is continuously withdrawn through horizontal reaction shaft assembly 20. In other embodiments, electric device 30 is intermittently repositioned within horizontal reaction shaft assembly 20. As shown in FIG. 1, electric device 30 may be withdrawn in a generally horizontal path in the direction indicated by arrow 52 through the carbonaceous deposit 11 to be gasified.

In alternative embodiments, electric device 30 is originally positioned near the injection end of horizontal reaction shaft assembly 20 and advanced in the direction indicated by arrow 52*a* from the injection end of horizontal reaction shaft assembly 20 towards the production end of horizontal reaction shaft assembly 20 during gasification. In such embodiments, electric device 30 may be pushed in a forward direction, i.e. the direction indicated by directional arrow 52*a*, as gasification of carbonaceous deposit 11 proceeds.

Electric device 30 provides intense heat to reaction zone 32. As such, it may be desirable to add a coolant media to reaction cavity 14 to temper the temperature near reaction zone 32, to temper the temperature of reaction cavity 14, and/or to temper the temperature of hot product gas 49*a* prior to entering product gallery 40 and/or production well assembly 42. Ideally, such a coolant media is water, in either liquid or gaseous form. Such water or steam may be taken from the cooling media added to electric device 30 that keeps the device from overheating, for example from cooling water and moderator path 38. Water in steam form creates superheated steam when in contact with the high temperature environment of reaction zone 32 via sensible heat transfer, while liquid water effects latent heat transfer through the flashing of liquid water to steam.

Electric device 30 cooling water may be introduced through a torch cooling water supply line 23 bundled within umbilical 36, a moderator line 27 bundled within umbilical 36, and/or into consumable casing 18 via cooling water and moderator line 28. Steam is created by waste heat in electric device 30, by heat from reaction cavity 14, and by flashing of water due to the high temperature of discharge gas 31 created by electric device 30.

Supplemental oxygen or other oxidant may be added to reaction zone 32 to provide partial oxidation of the carbon. This would add supplemental heat to reaction zone 32, which would lessen the amount of heat that would need to be added by means of electric device 30. Such reactant could be pure oxygen, air, oxygen-enhanced air, carbon dioxide, or a mixture thereof.

In preferred embodiments, water is the only fluid injected via injection well 15 following initiation of electric device 30.

The heat of the plasma and the gasification reactions erodes consumable casing 18, creating/enlarging reaction cavity 14. In the event that consumable casing 18 does not completely erode, boring bar, wedge or casing splitter 39 or similar device removes or otherwise disables the non-eroded portions of consumable casing 18 during repositioning of electric device 30 such that exposed but unreacted portions of coal deposit 11 are presented to the hot reaction cavity 14. In embodiments, the boring bar, wedge, or splitter 39 is held in a non-deployed position within the body of electric device 30 when the electric device is first introduced to horizontal reaction shaft 20; and then the boring bar, wedge or splitter 39 is deployed to a greater diameter than the diameter of consumable casing 18 during initiation of operation. Ash, or a slag of molten ash, flows downwardly to the bottom of horizontal reaction cavity 14. A significant portion of the trace mercury and trace heavy metals originally found in coal deposit 11 that is gasified will be sequestered in this glassy slag.

A monitoring station (not shown) may be provided for continuously monitoring the temperature, BTU value, gas fractional content, water content, opacity (ash content), and/or mass flow rate of the fuel product gas 49. Operating parameters, such as reactant and coolant injection rates, torch power, and/or the positioning of the device(s) 30 may be controlled in response to the monitoring. The increased kinetic rate of gasification supplied by the electric device 30 allows for faster feedback for determining the product parameters at surface 51.

Product gas 49 may be monitored to determine the BTU content, water content, opacity, temperature, mass flow rate, or a combination thereof. The monitoring may be continuous or intermittent. When electric device 30 is not being repositioned within horizontal reaction shaft assembly 20 with sufficient speed, gasification in the immediate cavity area will be substantially complete, which will present itself as a change in monitored product mix. The monitoring operation may be used to control operating parameters such as coolant and moderator flow rates and plasma electrical power during the gasification process. Control of the power to electric device 30, the rate of addition of reactants, and/or the rate of addition of coolant, allows the temperature within reaction zone 32, product gallery 40, and/or production well assembly 42 to be controlled, as well as the temperature and pressure within reaction cavity 14. This enables control of the composition of the product gas 49 produced, as different temperatures and/or pressures will create a product gas 49 of a different composition.

Electric device 30 is slowly repositioned along horizontal reaction shaft assembly 20 to reveal unreacted coal to the discharge gas heat and to the reactants. With reference to FIG. 5, discharge gas 31 created by electric device 30 may be directed at an angle from the withdrawal axis 58, and optionally, during gasification, discharge gas 31 may be rotated about withdrawal axis 58 by rotation of discharge head(s) 55 about rotatable joint 56. The utilization of the carbonaceous deposit 11 is thereby improved by directing the discharge gas 31 towards unreacted sections of the carbon deposit 11.

In embodiments, discharge head 55 is oriented to swivel around central axis 58, such that discharge gas 31 transcribes an angular path about central axis 58. In embodiments, discharge head 55 is rotatable about central axis 58 in a circular fashion. As such, when the discharge head is angled away from axis 58, and electric device 30 is both rotated about axis 58 via rotatable joint 56 and withdrawn along horizontal reaction shaft assembly 20, discharge gas 31 scribes a screw pattern in reaction cavity 14. Reaction cavity 14 may have a substantially oval shape, but this invention is not limited by the shape of the reaction cavity 14 produced by plasma gasification. By controlling the number of discharge heads 55, the path scribed by rotation thereof, and the rate of withdrawal or advancement of electric device 30 within horizontal reaction shaft assembly 20, the shape of reaction cavity 14 may be controlled. In thin seams, the shape of the reaction cavity may be created as an elongated oval. This feature may enable the underground gasification of carbonaceous deposits 11 that have previously been considered too deep and/or too thin for other in situ technologies.

The initial heat from electric device 30 causes a portion of the volatiles of the carbonaceous deposits 11 to be stripped off and, subsequently, with the introduction of moderator and oxidant, the remaining fixed carbon is gasified according to Equations (2) and (3), leaving behind ash and/or a slag of molten ash at the bottom of horizontal reaction shaft assembly 20. Upon complete gasification, the diameter of horizontal reaction shaft assembly 20 will have increased to the size of reaction cavity 14.

Via production well 42, hot product gases 49*a* are lead from reaction cavity(ies) 14, and optionally product galleries 40, to the surface 51. As discussed further hereinabove, in order to keep product casing 43 from overheating, it may be desirable to use one or more concentric outer casings 44, 45 that are filled with cooling water and/or steam to create useful high-pressure steam 41 by heat transfer with hot product gas 49*a*. At least a portion of high pressure steam 41 may be introduced into a steam turbine 53. Steam turbine 53 may produce electricity 54 to power electric device 30. Additional electricity produced may be used on-site or sold for profit. Because of the high electric usage of electric device(s) 30, an operator may choose to operate electric device 30 only during off-peak electrical demand periods, storing up heat in the reaction cavity 14 until the following non-peak electrical demand period. This is also true for product and process compressor equipment (not shown) at earth surface 51.

Turning to FIGS. 4 and 7, hot product gases 49*a* exit the production end of horizontal reaction shaft assembly 20, and enter product gallery 40 connecting several reaction cavities 14 or production well assembly 42. From product gallery 40, hot product gas 49*a* enters production well assembly 42 and exits at surface 51 as product gas 49. Product gas 49 collected at the topside end of production well assembly 42 may undergo surface processing. Once product gas 49 are collected at surface 51, the product gas 49 may be upgraded to pipeline quality or used in any other way, as known to those of skill in the art.

Product gas 49 may comprise any type of gas or gases, in varying volumes. For example, product gas 49 may comprise synthesis gas. Product gas 49 may comprise greater than about 25 volume percent $H_2$. In embodiments, product gas stream 49 comprises about 45 volume percent $H_2$. Product gas 49 may comprise greater than about 25 volume percent CO. In embodiments, product gas stream 49 comprises about 45 volume percent CO. Product gas stream 49 may comprise less than about 25 volume percent $CO_2$. In embodiments, product gas stream 49 comprises less than about 5 volume percent $CO_2$. Product gas stream 49 may comprise less than about 50 volume percent $H_2O$. In embodiments, product gas stream 49 comprises less than about 8 volume percent $H_2O$. Product gas 49 may further comprise one or more components selected from methane, hydrogen cyanide, ammonia, nitrogen gas, hydrogen sulfide, carbonyl sulfide and others. Desirably, the amount of these components in product gas 49 is less than about 5 volume percent.

Product gas 49 may exit production well assembly 42 at a high pressure. Because the product gas 49 is at a high pressure, the need for capital-intensive gas compressors at surface 51 may be eliminated and/or reduced via the disclosed method. The pressure of product gas 49 may be greater than about 2000 psi (13,789.5 kPa). Alternatively, the pressure of product gas 49 may be greater than about 1500 psi (10,342.1 kPa). In other embodiments, the pressure of product gas 49 may be greater than about 1073 psi (7,398 kPa). In other embodiments, the pressure of product gas 49 may be greater than about 3,028 psi (22,120 kPa).

Product gas 49 comprising synthesis gas at high pressure may be utilized as known to those of skill in the art. Synthesis gas may be utilized for the production of synthetic fuels as is known to those of skill in the art. Hydrogen may be recovered from product gas 49 for use as a power fuel, for oil refineries, and for the chemical industry. Synthesis gas can be utilized, for example, to produce commodity chemicals such as, but not limited to, methanol, DME, diesel, jet fuel, gasoline, acetyl chemicals, ethanol, ammonia, and combinations thereof. Carbon dioxide in product gas 49 may be recovered and utilized for any means known to those of skill in the art. For example, carbon dioxide gas in product gas stream 49 may be utilized for enhanced oil recovery (EOR). For use in most EOR operations, carbon dioxide should have a pressure of greater than about 1500 psi. Because product gas stream 49 exits production well 42 at high pressure, the carbon dioxide gas in product stream 49 may, in some embodiments, be utilized for EOR without first being compressed.

The disclosed underground gasification system and method may be used to gasify about 40 ton/hour (40.64 tonne/hr) or more of carbonaceous deposit per horizontal reaction shaft assembly 20. Product gas 49 may be produced at greater than about 2,500 MCF (MCF=1000 cubic feet) (70,792 $m^3$). In specific embodiments, product gas 49 may be produced at about 2,684 MCF (76,002 $m^3$). Product gas 49 may comprise greater than 200 BTU/SCF HHV (41.8 kJ/$m^3$). In embodiments, product gas 49 comprises about 318 BTU/SCF HHV (66.5 kJ/$m^3$). Product gas 49 may comprise greater than 250 BTU/SCF LHV (52.3 kJ /$m^3$). In embodiments, product gas 49 comprises about 290 BTU/SCF LHV (60.6 kJ/$m^3$). Product gas 49 may be produced at more than about 600 MMBTU/h (633,034 MJ/h). Product gas 49 may be produced at more than about 700 MMBTU/h (738,539 MJ/h). In some specific embodiments, product gas 49 may is produced at about 789 MMBTU/h (832,439 MJ/h) of chemical energy, net of thermal or kinetic energy.

The disclosed system and method eliminates traditional mining costs, transportation costs, strip mining, and underground personnel by "mining" carbonaceous material out of the ground by gasifying it and bringing energy to the surface 51. The disclosed systems and methods enable very deep operation, with long horizontal reaction shaft assemblies, rather than shallow wells and close well centers, typical with traditional UCG, which are more disruptive to the environment. Via the disclosed system(s) and method(s), the electric device 30 may be directional and the temperature, pressure, and reaction rates may be adjusted to alter the composition of product gas 49. Traditional UCG methods are passive air or oxygen injection methods, which do not allow for control over the shape of reaction cavity 14 or substantial control of reaction temperatures.

Via the disclosed system and method, synthesis gas-comprising product gas 49 may be produced for less than the cost of synthesis gas from traditional gasifiers. For example, synthesis gas 49 may be produced at about $1.30/mmBTU ($1.23 per GJ) at the head of production well 42. In embodiments, electric device 30 utilizes about 10 MW of electricity 54, and this may be supplied via steam turbine 53 or other power sources. The amount of energy consumed by electric device 30 may be about 5%-15% of the gross energy of the gasification reactions.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A system for the gasification of a carbonaceous deposit located below the ground surface, the system comprising:

an injection well assembly comprising one end positioned at the ground surface and the opposite end of the injection well assembly located within the carbonaceous deposit;

a production well assembly comprising one end positioned at the ground surface and the opposite end of the production well assembly located within the carbonaceous deposit;

a non-vertical reaction shaft assembly located within the carbonaceous deposit a distance below ground surface, the non-vertical reaction shaft having a length and comprising an injection end in communication with the end of the injection well assembly located within the carbonaceous deposit and a production end in communication with the end of the production well assembly located within the carbonaceous deposit; and a mobile electric device configured to move within the non-vertical reaction shaft assembly;

wherein the production well assembly further comprises a product casing, a steam jacket casing surrounding at least a portion of the product casing, and an external water jacket casing surrounding at least a portion of the steam jacket casing, wherein the external water jacket casing comprises an inlet for water and wherein the steam jacket casing comprises an outlet for steam and wherein the product casing transfers product gasification gas from the non-vertical reaction shaft assembly to the surface.

2. The system of claim 1 wherein the carbonaceous deposit comprises at least one selected from the group consisting of coals, kerogen, shale oils, tar sands, and combinations thereof.

3. The system of claim 1 wherein the injection well assembly is within 15 degrees of vertical.

4. The system of claim 1 wherein the non-vertical reaction shaft assembly diverges from vertical by more than 15 degrees.

5. The system of claim 1 wherein the mobile electric device comprises a non-transferred arc plasma torch.

6. The system of claim 1 wherein the mobile electric device is a mobile directional electric device.

7. The system of claim 1 wherein the mobile electric device comprises two opposed discharge heads.

8. The system of claim 1 wherein the non-vertical reaction shaft is at least partially lined by a thermally-consumable casing material.

9. The system of claim 1 wherein the distance below ground surface is greater than about 1,000 feet (304.8 m).

10. The system of claim 1 wherein the length of the non-vertical reaction shaft is greater than 1,000 feet (304.8 m).

11. The system of claim 1 wherein the only fluid inlet into the system is one or more inlets for water.

12. The system of claim 1 wherein at least one of the steam jacket casing and the product casing is capable of expanding independently and/or at different rates of thermal expansion as compared to the external water jacket casing.

13. The system of claim 12 wherein at least one casing selected from the product casing and the steam jacket casing comprises spacers, whereby the selected casing remains substantially concentric with the external water jacket casing during gasification of the carbonaceous deposit.

14. A method for gasifying a carbonaceous deposit located below the ground surface, the method comprising:

positioning a mobile electric device comprising a discharge head within a non-vertical reaction shaft assembly, the non-vertical reaction shaft assembly having a length, an injection end, and a production end, and wherein the non-vertical reaction shaft assembly is positioned at least partially within the carbonaceous deposit a distance of at least 1,000 feet (304.8 m) below ground;

creating a discharge gas at a temperature with the mobile electric device whereby at least a portion of the carbonaceous deposit is gasified producing a reaction cavity; and injecting water as coolant, reactant, and/or moderator during gasification, whereby the mobile electric device produces steam and oxygen for its operation.

15. The method of claim 14 wherein the carbonaceous deposit comprises at least one selected from the group consisting of coals, kerogen, shale oils, tar sands, and combinations thereof.

16. The method of claim 14 wherein the mobile electric device is attached to one end of each of at least one retaining cables whereby each of the at least one retaining cables extends from the mobile electric device through an injection well to the ground surface; and wherein the production end of the non-vertical reaction shaft assembly is in communication with a below-ground end of a production well, and wherein the injection well comprises one end in communication with the ground surface and one end in communication with the injection end of the non-vertical reaction shaft assembly.

17. The method of claim 16 wherein the at least one retaining cable surrounds or comprises one or more selected from insulated electrical conductors, grounds, and combinations thereof.

18. The method of claim 16 wherein the production well further comprises: a product casing adapted to transfer product gasification gas from the non-vertical reaction shaft assembly to the surface; a steam jacket casing surrounding at least a portion of the product casing, the steam jacket casing having an outlet; and an external water jacket casing surrounding at least a portion of the steam jacket casing, the external water jacket casing having an inlet; and wherein the method further comprises injecting water into the inlet of the external water jacket casing and extracting steam from the outlet of the steam jacket casing.

19. The method of claim 18 wherein at least one of the steam jacket casing and the product casing is capable of expanding independently and/or at a different rate of thermal expansion as compared to the water jacket casing.

20. The system of claim 19 wherein at least one casing selected from the product casing and the steam jacket casing comprises spacers, whereby the at least one selected casing remains substantially concentric with the external water jacket casing during gasification of the carbonaceous deposit.

21. The method of claim 14 wherein the non-vertical reaction shaft assembly diverges from vertical by more than 15 degrees.

22. The method of claim 14 wherein the mobile electric device comprises a non-transferred arc plasma torch.

23. The method of claim 14 wherein the mobile electric device comprises at least two discharge heads.

24. The method of claim 14 wherein the mobile electric device is a mobile directional electric device.

25. The method of claim 14 wherein the distance below ground surface is greater than about 3,000 feet (914.4 m).

26. The method of claim 14 wherein the length of the non-vertical reaction shaft is greater than 1,000 feet (304.8 m).

27. The method of claim 14 wherein water is the only fluid injected into the electric device and the non-vertical reaction shaft assembly.

28. The method of claim 14 wherein the temperature of the discharge gas is greater than about 2,000° F. (1,093° C.) at centerline of the discharge gas.

29. The method of claim 28 wherein the discharge gas is an electric arc and wherein the temperature of the electric arc is greater than about 8,000° F. (4,426° C. at centerline of the electric arc.

30. The method of claim 14 further comprising repositioning the electric device along the non-vertical reaction shaft whereby another portion of the carbonaceous deposit may be gasified.

31. The method of claim 30 wherein repositioning the electric device comprises positioning the electric device closer to the injection end of the non-vertical reaction shaft assembly.

32. The method of claim 16 further comprising collecting product gases that exit the production well at the ground surface.

33. The method of claim 32 further comprising monitoring the product gases to determine at least one product parameter selected from the group consisting of gas temperature, BTU value, gas content, water content, opacity (ash content), mass flow rate of the product gas, and combinations thereof.

34. The method of claim 33 further comprising adjusting at least one operating parameter in response to the monitoring.

35. The method of claim 34 wherein the at least one operating parameter is selected from the group consisting of injection rate of fluid provided to the mobile electric device, electric device power, positioning of the mobile electric device within the non-vertical reaction shaft assembly and combinations thereof.

36. The method of claim 14 wherein the method is utilized to continuously gasify portions of the carbonaceous deposit along substantially the entire length of the non-vertical reaction shaft assembly.

37. The method of claim 14 further comprising operating the mobile electric device only during off-peak electrical demand periods, and storing up heat in the reaction cavity until another non-peak electrical demand period.

38. A method for gasifying a carbonaceous deposit located below the earth's surface, the method comprising:

positioning a plasma device within a horizontal reaction shaft located at least 1,000 feet (304.8 m) below the surface, the horizontal reaction shaft having a length, an injection end, and a production end, and wherein the horizontal reaction shaft is positioned at least partially within the carbonaceous deposit;

injecting water as coolant, reactant, and/or moderator during gasification, whereby the plasma device produces steam and oxygen for its operation during gasification; and gasifying at least a portion of the carbonaceous deposit using a plasma gas.

39. The method of claim 38 wherein the water is the only fluid introduced into the plasma device during substantially all of the gasifying of the carbonaceous deposit.

40. The method of claim 38 wherein the water is the only fluid introduced into the horizontal reaction shaft during substantially all of the gasifying of the carbonaceous deposit.

* * * * *